US009963324B2

(12) United States Patent
Virta et al.

(10) Patent No.: US 9,963,324 B2
(45) Date of Patent: May 8, 2018

(54) ELEVATOR

(71) Applicant: KONE Corporation, Helsinki (FI)

(72) Inventors: Veli-Matti Virta, Helsinki (FI); Markus Salmi, Helsinki (FI); Kim Pönkä, Helsinki (FI)

(73) Assignee: KONE CORPORATION, Helsinki (FI)

( * ) Notice: Subject to any disclaimer, the term of this patent is extended or adjusted under 35 U.S.C. 154(b) by 0 days. days.

(21) Appl. No.: 15/613,858

(22) Filed: Jun. 5, 2017

(65) Prior Publication Data

US 2018/0002141 A1 Jan. 4, 2018

(30) Foreign Application Priority Data

Jun. 29, 2016 (EP) ..... 16176889

(51) Int. Cl.
*B66B 7/10* (2006.01)
*B66B 11/00* (2006.01)
(Continued)

(52) U.S. Cl.
CPC ..... *B66B 11/0005* (2013.01); *B66B 7/02* (2013.01); *B66B 9/00* (2013.01); *B66B 11/008* (2013.01); *B66B 5/28* (2013.01)

(58) Field of Classification Search
CPC ..... B66B 11/0005; B66B 7/02; B66B 9/00; B66B 11/008; B66B 5/28
See application file for complete search history.

(56) References Cited

U.S. PATENT DOCUMENTS 2,537,075 A * 1/1951 Margles ..... B66B 7/068 187/264
3,845,842 A * 11/1974 Johnson ..... B66B 11/0045 187/266

(Continued)

FOREIGN PATENT DOCUMENTS

DE 199 31 396 A1 1/2001
JP 2006-16184 A 1/2006

OTHER PUBLICATIONS

European Seareb Report of eppitcation EP 15 17 6889, dated Dec. 13, 2015.

*Primary Examiner* — Michael A Riegelman
(74) *Attorney, Agent, or Firm* — Birch, Stewart, Kolasch & Birch, LLP

(57) ABSTRACT

An elevator includes a hoistway; an elevator car vertically movable in the hoistway, the passage to and/or from the elevator car being provided in depth direction of the hoistway; a counterweight vertically movable in the hoistway beside the elevator car in width direction of the hoistway; one or more ropes interconnecting the elevator car and the counterweight and hanging from these; a rope wheel arrangement in the bottom end of the hoistway for guiding the one or more ropes; and a vertically oriented guide rail for guiding the elevator car extending between the elevator car and counterweight. The elevator includes a bridge structure mounted on the floor of the hoistway, the bridge structure including a cross member, wherein the guide rail for guiding the elevator car is mounted on top of the cross member, the bridge structure including a passage for the one or more ropes below the cross member, and the one or more ropes pass from the counterweight downwards to the rope wheel arrangement, and the rope wheel arrangement is arranged to guide the one or more ropes to pass below the cross member via said passage and up to the elevator car.

20 Claims, 4 Drawing Sheets

(51) Int. Cl.

| | |
|---|---|
| ***B66B 7/02*** | (2006.01) |
| ***B66B 9/00*** | (2006.01) |
| *B66B 5/28* | (2006.01) |

(56) References Cited

U.S. PATENT DOCUMENTS

| | | | | |
|---|---|---|---|---|
| 3,882,968 | A * | 5/1975 | Suozzo | B66B 7/068 187/264 |
| 4,230,205 | A * | 10/1980 | Darwent | B66B 7/068 187/265 |
| 5,513,724 | A * | 5/1996 | De Jong | B66B 5/284 187/264 |
| 7,178,636 | B2 * | 2/2007 | Kato | B66B 11/004 187/250 |
| 2001/0025743 | A1 * | 10/2001 | Ach | B66B 7/10 187/264 |
| 2002/0070080 | A1 * | 6/2002 | Nakagaki | B66B 7/027 187/266 |
| 2006/0249337 | A1 | 11/2006 | McNamara et al. | |
| 2007/0246303 | A1 * | 10/2007 | Zamorano Morfin | B66B 9/02 187/254 |
| 2008/0202863 | A1 * | 8/2008 | Rossignol | B66B 7/062 187/393 |

* cited by examiner

ELEVATOR

FIELD OF THE INVENTION

The invention relates to an elevator for vertically transporting passengers and/or goods.

BACKGROUND OF THE INVENTION

An elevator typically comprises an elevator car and a counterweight, which are vertically movable in a hoistway. These elevator units are typically interconnected by suspension ropes that suspend these elevator units on opposite sides of one or more rope wheels mounted higher than these elevator units. For providing force for moving the suspension ropes, and thereby also for the elevator car and a counterweight, one of the wheels is typically a drive wheel engaging the suspension ropes. The elevator car and the counterweight may need to be interconnected by ropes which hang from the elevator car and the counterweight. This type of ropes are often used to provide compensation for the weight of the hoisting ropes. Particularly, in this way the unbalance, which is caused by the suspension ropes in situations where the elevator car is run to its extreme position, can be eliminated. However, these ropes may alternatively or additionally be used to provide a so called tie-down function for the elevator.

When the passage to and/or from the elevator car is provided in depth direction of the hoistway, the counterweight can be positioned on the back i.e. in depth direction of the opposite side of the car than the doorway. Thus, the car can be made large in width direction. Alternatively, the counterweight can be positioned on side of the elevator car, i.e. beside the elevator car in width direction of the hoistway. Positioning the counterweight on the side of the car is needed when there is a need for long and deep cars, which is the case often with goods elevators and hospital elevators. Positioning the counterweight on the side of the car is also needed when through-type cars are required or shaft dimensions dictate the usage of side counterweight layout. Sometimes scenic elevators require a side counterweight solution.

Elevators typically need to have vertically oriented guide rails for guiding the elevator car as well as corresponding guide rails for guiding the counterweight. Therefore, in addition to challenges in positioning of the counterweight, a further challenge is to position the guide rails such that access to the car is possible via one or both depth directional sides thereof and the car is still spacious. The guide rails and the roping need to be positioned relative to each other such that the ropes do not touch the guide rails. A drawback of the prior solutions has been that the guide rails and the ropes hanging between the car and counterweight have not been positioned relative to each other with simple and space efficient layout.

In prior art, such elevators with a counterweight on the side are known which have its car guide rails in width direction of the hoistway on opposite sides of the elevator car. Thus, on one side of the car there are the guide rail of the car and the counterweight. Each compensation rope hanging between the car and counterweight have been routed to go around the guide rail positioned between the car and guide rail. In prior art this has been realized either with a skewed configuration where the ropes cross the guide rail plane or with a parallel configuration where the ropes pass beside the guide rail plane parallel therewith. In either alternatives, the ropes have been routed to pass beside the guide rails with a clearance ensuring that no chafing occurs.

Each rope is are attached to a suspension point (e.g. rope terminals) at the car and counterweight.

A drawback of these solutions has been that they are complicated and difficult to manufacture space efficiently such that no considerable unbalance is produced on the car or counterweight nor considerable asymmetry in lateral support forces taken from the guide rails by the guide rollers or guide sliders. These drawbacks are emphasized when the elevator is to have great number of ropes and/or large-sized ropes.

An option contemplated by the applicant is to divide the roping into two sets of compensation ropes placed on opposite sides of the guide rail plane such that the guide rail is between the two rope sets in depth direction of the hoistway. A drawback is noticed to be that with great number of ropes or with large-sized ropes, e.g. belt-shaped ropes, the total width of the ropes with the necessary spacing between the ropes, leads to a roping termination that is in depth direction very large, and even larger than the size of the counterweight. A larger counterweight would require a bigger hoisting machinery/drive altogether and/or more robust guide rails. Furthermore, the space consumption of the compensation roping would exclude small car types from offering. A further drawback is that this solution is with most layouts prone to require two rope wheel sets, one on each side of the guide rail.

BRIEF DESCRIPTION OF THE INVENTION

The object of the invention is to introduce an elevator with the counterweight positioned on the side which elevator has an improved layout. An object is to introduce a solution by which one or more of the above described shortcomings and/or shortcomings discussed or implied elsewhere in the description can be alleviated. Embodiments are presented, inter alia, by which ropes hanging between the car and counterweight can be placed space efficiently and such that the car guidance and the rope suspension can be designed substantially central and simple. Furthermore, embodiments are presented, inter alia, where the compensation roping does not cause considerable asymmetry in lateral support forces taken from the guide rails by the guide rollers or guide sliders can. Embodiments are presented, inter alia, where the above mentioned are achieved and the elevator is provided with a compensator device having complicated structure providing tie-down function for the elevator.

It is brought forward a new elevator comprising a hoistway having a height direction, width direction and depth direction; an elevator car vertically movable in the hoistway, the passage to and/or from the elevator car being provided in depth direction of the hoistway; particularly via the front side of the elevator car; a counterweight vertically movable in the hoistway beside the elevator car in width direction of the hoistway, particularly between a hoistway wall and a lateral side wall of the elevator car; one or more ropes interconnecting the elevator car and the counterweight and hanging from these; a rope wheel arrangement in the bottom end of the hoistway for guiding the one or more ropes; the one or more ropes passing around rope wheels of the rope wheel arrangement, and a vertically oriented guide rail for guiding the elevator car extending vertically between the elevator car and counterweight. The elevator comprises a bridge structure mounted on the floor of the hoistway, the bridge structure comprising a cross member, wherein the guide rail for guiding the elevator car is mounted on top of the cross member, the bridge structure comprising a passage for the one or more ropes below the cross member, and the one or more ropes pass from the counterweight downwards to the rope wheel arrangement, and the rope wheel arrangement is arranged to guide the one or more ropes to pass below the cross member via said passage and up to the elevator car. With this solution one or more of the above mentioned objects can be achieved. Preferable further details are introduced in the following, which further details can be combined with the rope individually or in any combination.

In a preferred embodiment, the cross member is arranged to support the guide rail vertically. Then, the guide rail is placed to rest on top of the cross member of the bridge structure, in particular on an upper face thereof.

In a preferred embodiment, the cross member comprises an upper face on top of which the guide rail is mounted, and which is more than 1 m above the upper face of the floor of the hoistway, yet below the sill of the lowermost landing of the elevator. The guide rail preferably rests on said upper face, as mentioned above.

In a preferred embodiment, the cross member comprises an upper face on top of which the guide rail is mounted, and a lower face delimiting the passage below it. The lower face is preferably more than 0.8 m above the upper face of the floor of the hoistway, yet below the sill of the lowermost landing of the elevator. The upper and lower face are the opposite faces of the cross member. The guide rail preferably rests on said upper face, as mentioned above.

In a preferred embodiment, the sill of the lowermost landing of the elevator is more than 1 m above the upper face of the floor of the hoistway.

In a preferred embodiment, said one or more ropes comprise one or more ropes that pass below the bridge structure such that they cross the vertical projection of the guide rail.

In a preferred embodiment, said one or more ropes comprise one or more ropes that are connected with a suspension point of the counterweight and with a suspension point of the elevator car, which suspension points are on the same vertical plane as the guide rail. Said same vertical plane is preferably parallel with width direction of the hoistway.

In a preferred embodiment, the passage extends below the cross member in width direction of the hoistway, whereby one or more ropes can pass via it in width direction of the hoistway.

In a preferred embodiment, the bridge structure comprises a first support leg and a second support leg, standing on the floor of the hoistway, which first and second support leg are displaced in depth direction of the hoistway, which first and second support leg each support vertically the cross member, the passage extending below the cross member between the first and second leg in width direction of the hoistway. Said cross member is preferably oriented horizontally. Said elongated support legs are preferably oriented vertically. The cross member is preferably connected with the upper ends of the first and second support leg.

In a preferred embodiment, each of said first support leg, said second support leg and said cross member is elongated and positioned such that the central axis thereof extends along a common vertical plane extending parallel with depth direction of the hoistway.

In a preferred embodiment, each of said first support leg, said second support leg comprises a metal beam.

In a preferred embodiment, the cross member comprises a metal beam.

In a preferred embodiment, the bridge structure is immovably mounted on the floor of the hoistway, in particular such that it rests on the floor of the hoistway.

In a preferred embodiment, the bridge structure has substantially the shape of a letter U turned upside down.

In a preferred embodiment, the guide rail is positioned between the central third of the depth of the elevator car and the central third of the depth of the counterweight.

In a preferred embodiment, the suspension point of the counterweight is positioned within the central third of the depth of the counterweight and the suspension point of the elevator car is positioned within the central third of the depth of the elevator car.

In a preferred embodiment, the one or more ropes are belt-shaped.

In a preferred embodiment, the one or more ropes comprises plurality of ropes. Each of the plurality of ropes preferably passes along a vertical plane extending parallel with width direction of the hoistway, the planes of the ropes being adjacent in depth direction of the hoistway.

In a preferred embodiment, said rope wheel arrangement comprises a first rope wheel, and a second rope wheel, which have parallel horizontal rotational axes, and the first rope wheel is arranged to divert the rope(s) arriving thereto from the counterweight to pass to the second rope wheel, and the second rope wheel is arranged to divert the rope(s) arriving thereto to pass up to the elevator car. Preferably, said parallel rotational axes are oriented parallel with depth direction of the hoistway, and the first rope wheel, and the second rope wheel are beside each other in width direction of the hoistway.

In a preferred embodiment, the second rope wheel is at least partially below the cross member of the bridge structure and at least partially overlaps the vertical projection thereof.

In a preferred embodiment, said rope wheel arrangement is mounted on the floor of the hoistway.

In a preferred embodiment, said rope wheel arrangement is separate from the bridge structure.

In a preferred embodiment, said rope wheel arrangement comprises a frame mounted immovably on the floor of the hoistway on which frame the rope wheels of the rope wheel arrangement are mounted.

In a preferred embodiment, the rope wheels of the rope wheel arrangement are mounted vertically movably on said frame mounted immovably on the floor of the hoistway.

In a preferred embodiment, said rope wheel arrangement comprises a casing inside which the rope wheels are mounted and which is mounted vertically movably on the frame mounted immovably on the floor of the hoistway.

In a preferred embodiment, said frame of the rope wheel arrangement is separate from the bridge structure.

In a preferred embodiment, said rope wheel arrangement comprises only non-driven rope wheels. Said one or more ropes interconnecting the elevator car and the counterweight being arranged to pass around non-driving rope wheels only.

In a preferred embodiment, the elevator comprises one or more suspension ropes interconnecting the elevator car and the counterweight, and a rope wheel arrangement of the one or more suspension ropes in or at least in proximity of the upper end of the hoistway for guiding the one or more suspension ropes, the one or more suspension ropes passing around rope wheels of the rope wheel arrangement, and a motor for rotating a rope wheel of the of the rope wheel arrangement of the one or more suspension ropes.

In a preferred embodiment, for the purpose of guiding the elevator car, the elevator comprises vertically oriented guide rails for guiding the car extending vertically on opposite sides of the elevator car in width direction of the hoistway. Said guide rails comprise said vertically oriented guide rail for guiding the elevator car extending vertically between the elevator car and counterweight. The guide rails of the elevator car are positioned furthermore preferably such that their vertical longitudinal axes are on a common vertical plane extending parallel with width direction of the hoistway.

In a preferred embodiment, the elevator comprises vertically oriented guide rails for guiding the counterweight. These guide rails extend vertically, preferably on opposite sides of the counterweight in depth direction of the hoistway.

In a preferred embodiment, for enabling guidance of the elevator car, the elevator comprises guide members mounted on the elevator car and arranged to lean horizontally on the guide rails of the elevator car.

In a preferred embodiment, the elevator preferably comprises one or more buffers for the elevator car mounted on the floor of the hoistway below the elevator car. In the preferred embodiment, there are two buffers on opposite sides of the vertical guide rail plane of the elevator car along which the guide rails of the elevator car extend. The buffers are positioned furthermore preferably such that their vertical longitudinal axes are on a common vertical plane extending parallel with depth direction d of the hoistway. Said plane preferably extends via center of gravity of the elevator car.

In a preferred embodiment, the elevator comprises one or more buffers for the counterweight. Then, there is a buffer for the counterweight mounted on the floor of the hoistway below the counterweight. The buffer can be positioned furthermore preferably such that its vertical longitudinal axis is on the same vertical plane extending parallel with width direction d of the hoistway on which the guide rail of the elevator car is positioned. Said plane preferably extends via center of gravity of the elevator car.

In a preferred embodiment, the elevator car has a frontside wall, backside wall and opposite lateral side walls connecting the frontside wall and backside wall, and said passage to and/or from the elevator car is provided through the front side wall of the elevator car, in particular through a door comprised in the elevator car and leading through the front side wall in depth direction of the hoistway. The vertical projection of elevator car is preferably substantially rectangular.

In a preferred embodiment, the elevator comprises a landing, a landing door and a car door through which a landing door and a car door passengers can pass between the car and the landing in depth direction of the hoistway when the car is parked at the landing and the doors are open.

In a preferred embodiment, each said guide rail is T-shaped in cross section. Generally, each said guide rail can be formed of consecutive guide rail sections.

The elevator is preferably such that the car thereof is configured to serve two or more vertically displaced landings. The elevator is preferably configured to control movement of the car in response to signals from user interfaces located at landing(s) and/or inside the car so as to serve persons on the landing(s) and/or inside the elevator car. Preferably, the car has an interior space suitable for receiving a passenger or passengers or goods, and the car can be provided with a door for forming a closed interior space.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
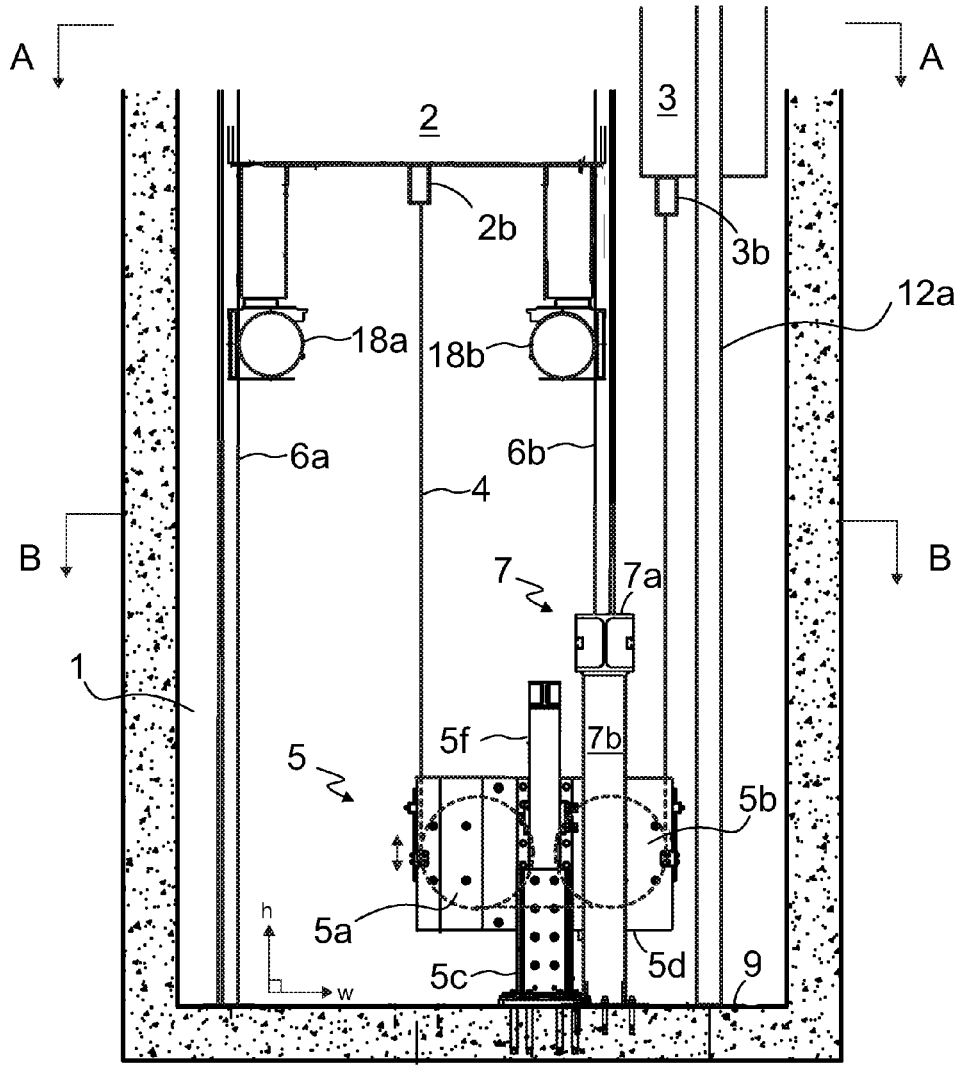
FIG. 1 illustrates a view of a preferred embodiment of an elevator according to the invention as viewed in depth direction of the hoistway of the elevator.

FIG. 1 illustrates the lower parts of an elevator according to a preferred embodiment. The elevator comprises a hoistway 1 having a height direction h, width direction w and depth direction d (which are in right angle relative to each other), and an elevator car 2 vertically movable in the hoistway 1. The passage to and/or from the elevator car 2 is provided in depth direction d of the hoistway 1.

The elevator car 2 has a frontside wall, backside wall and opposite lateral side walls connecting the frontside wall and backside wall, and said passage to and/or from the elevator car 2 is provided through the front side wall of the elevator car 2, in particular through a door 16 comprised in the elevator car 2 and leading through the front side wall in depth direction d of the hoistway 1.

The elevator comprises a counterweight 3 vertically movable in the hoistway 1 beside the elevator car 2 in width direction w of the hoistway 2, particularly between the wall of the hoistway 1 and a lateral side wall of the elevator car 2.

The elevator further comprises one or more ropes 4 interconnecting the elevator car 2 and the counterweight 3 and hanging from these, and a rope wheel arrangement 5 in the bottom end of the hoistway 1 for guiding the one or more ropes 4. The one or more ropes 4 pass around rope wheels 5*a*, 5*b* of the rope wheel arrangement 5.

For the purpose of guiding the elevator car (2, the elevator comprises vertically oriented guide rails 6*a*,6*b* for guiding the car extending vertically on opposite sides of the elevator car in width direction of the hoistway 1. Said guide rails 6*a*,6*b* comprise a vertically oriented guide rail 6*b* for guiding the elevator car 2 extending vertically between the elevator car 2 and counterweight 3. The guide rails of the elevator car are positioned furthermore preferably such that their vertical longitudinal axes are on a common vertical plane 20 extending parallel with width direction w of the hoistway 1.

The guide rail 6*b* is positioned such that it extends vertically between the central third of the depth of the elevator car 2 and the central third of the depth of the counterweight 3. Thus, it is positioned beside the central portion of the car and counterweight. This means that passage of ropes 4 hanging between the car and counterweight 3 is not totally free when these are suspended from a suspension points 2*a*, 3*a* that are positioned within the central portion of the car and counterweight, and in particular such that the suspension point 3*a* of the counterweight 3 is positioned within the central third of the depth of the counterweight 3 and the suspension point 2*a* of the elevator car 2 is positioned within the central third of the depth of the elevator car 2.

The elevator comprises a bridge structure 7 mounted on the floor 9 of the hoistway 1, the bridge structure comprising a cross member 7*a*, wherein the guide rail 6*b* for guiding the elevator car 2 is mounted on top of the cross member 7*a*, the vertical projections of the guide rail 6*b* and the cross member 7*a* overlapping. Thereby the guide rail 6*b* does not block passage of ropes 4 across the gap between the car 2 and counterweight 3 below the cross member 7*a*. The cross member 7*a* blocks the guide rail 6*a* from falling below it in the passage 8.

The bridge structure 7 comprises a passage 8 for the one or more ropes 4 below the cross member 7*a*. The passage 8 extends below the cross member 7*a* in width direction w of the hoistway 1, whereby one or more ropes 4 can pass via it in width direction w of the hoistway 1. The one or more ropes 4 pass from the counterweight 3 downwards to the rope wheel arrangement 5, and the rope wheel arrangement 5 is arranged to guide the one or more ropes 4 to pass in width direction w of the hoistway 1 below the cross member 7*a* via said passage 8 and up to the elevator car 2. The guide rail 6*a* does not extend below the cross member 7*a* nor can it fall accidentally below the cross member 7*a*.

Figure 2:
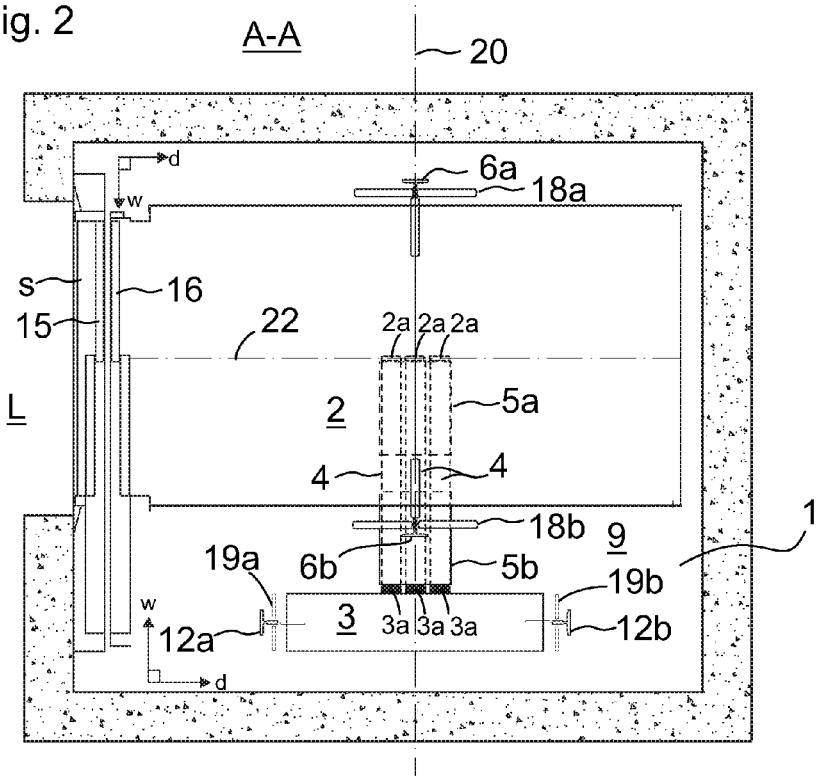
FIG. 2 illustrates a cross-sectional view A-A of FIG. 1.
Figure 3:
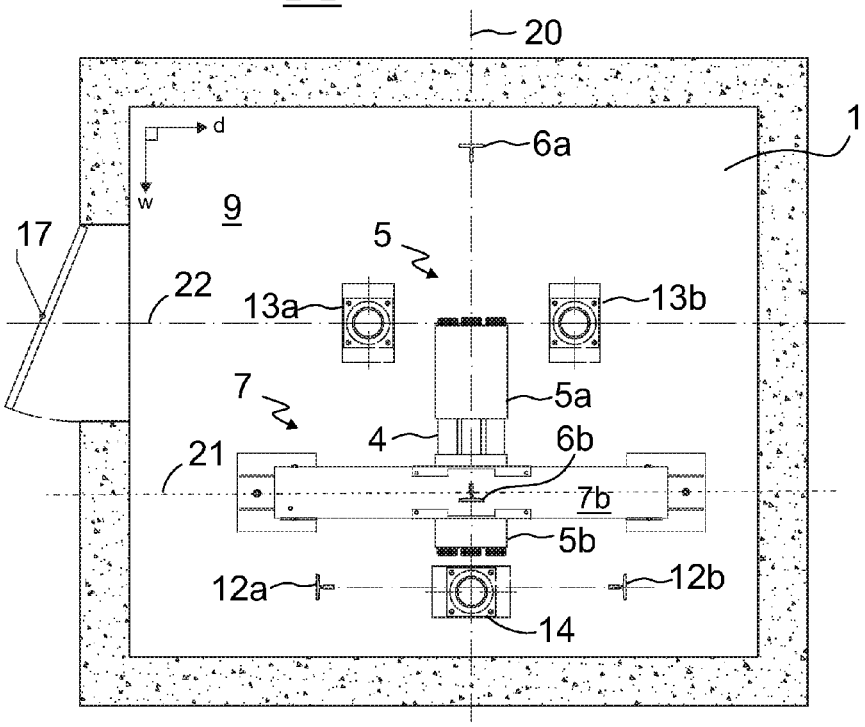
FIG. 3 illustrates a cross-sectional view B-B of FIG. 1.
Figure 4:
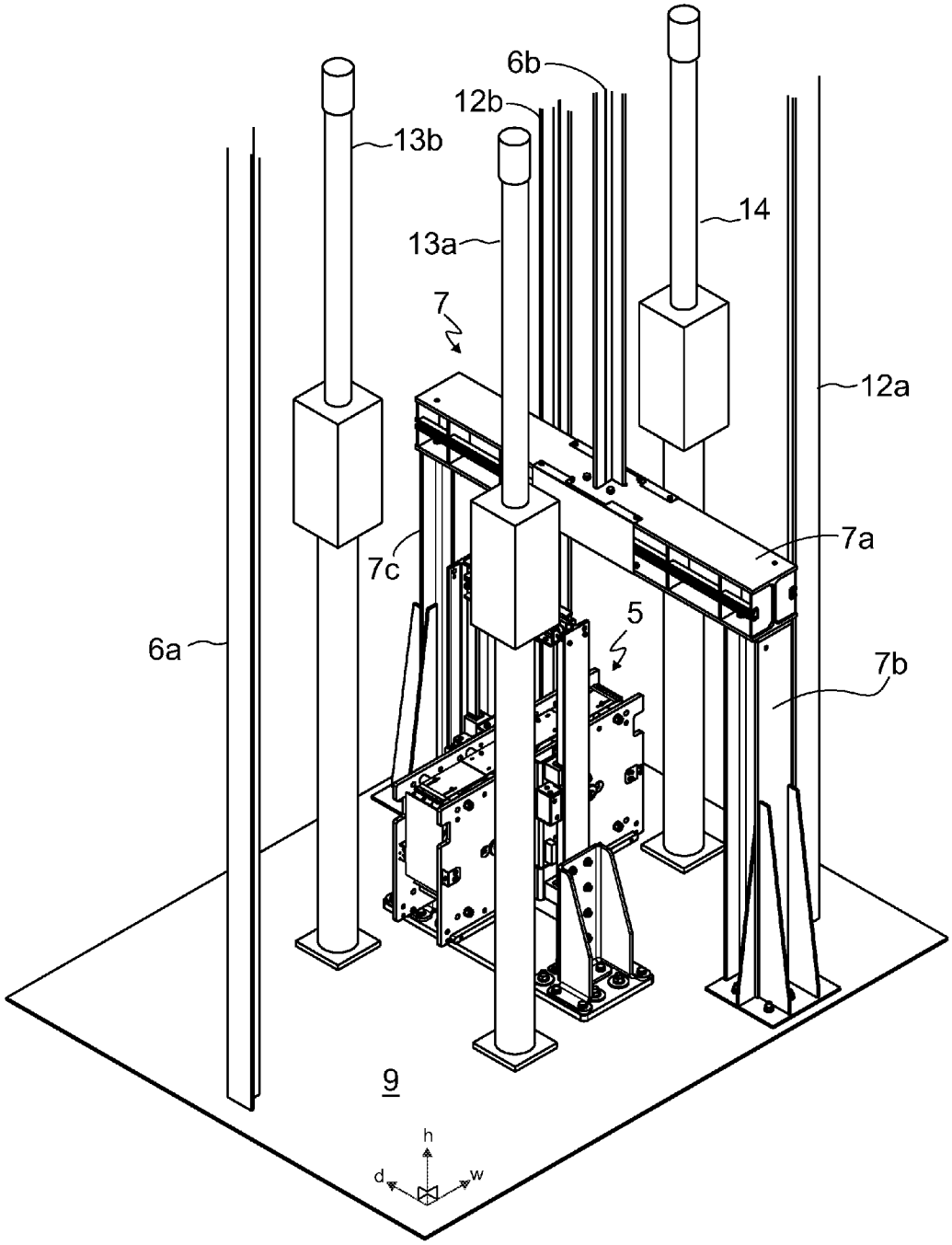
FIG. 4 illustrates three dimensionally from a first view angle the lower end of the hoistway of FIG. 1 (ropes not showed).
Figure 5:
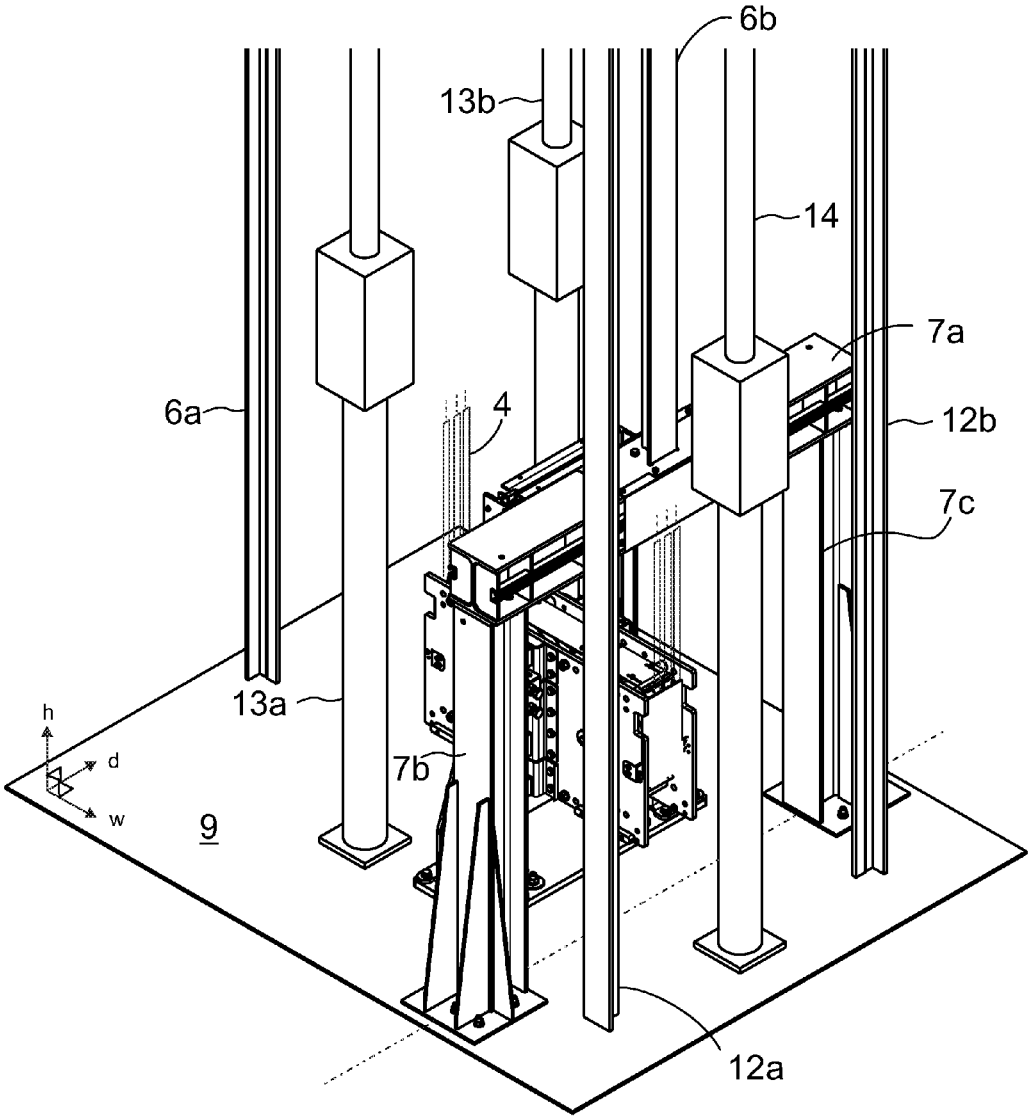
FIG. 5 illustrates three dimensionally from a second view angle the lower end of the hoistway of FIG. 1.

In the preferred embodiment illustrated in Figures, said one or more ropes 4 comprise a rope 4 that pass below the bridge structure 7 such that is cross the vertical projection of the guide rail 6*b*. This can be seen in FIGS. 2 and 3 where the centermost of the ropes 4 of the ropes illustrated passes right below the guide rail 6*b*. Said rope 4 (the centermost in Figures) is connected with a suspension point 3*a* of the counterweight 3 and with a suspension point 2*a* of the elevator car 2, which suspension points 2*a*,3*a* are on the same vertical plane 20 as the guide rail 6*b*. Said same vertical plane 20 on the other hand is parallel with width w direction of the hoistway 1, whereby said rope 4 passes along a vertical plane that parallel with width w direction of the hoistway 1. The layout is thus not diagonal or skewed in this respect which makes the construction simple, clean-cut and esthetic.

In the preferred embodiment, the elevator comprises a landing 17, a landing door 15 and a car door 16 through which a landing door 15 and a car door 16 15,16 passengers can pass between the car 2 and the landing 17 in depth direction d of the hoistway 1 when the car is parked at the landing and the doors 15,16 are open. The elevator may also comprise a pit access door 17 provided with a lock openable with a key. The pit access door 17 can not to be used by passengers, but only by authorized persons e.g. for maintenance work.

The cross member 7*a* comprises an upper face on top of which the guide rail 6*b* is mounted, and a lower face delimiting the passage 8 below it. The upper face is preferably more than 1 m above the upper face of the floor 9 of the hoistway 1, yet below the sill of the lowermost landing L of the elevator. Thus, it need not be positioned such that it delimits the vertical path of the elevator car, yet the height of the passage can be simply dimensioned considerably high. The lower face is preferably more than 0.8 m above the upper face of the floor 9 of the hoistway 1, yet below the sill of the lowermost landing of the elevator whereby the ropes can be guided with clearance sufficient for most elevators configurations. This height also enables freedom to position part of the structure of the rope wheel arrangement 5 to extend partially below the cross member 7*a*, which facilitates considerably the cross sectional space efficiency and freedom of layout design of the elevator in different installation sites. The great height of the passage, and these dimensions particularly also provide that the rope wheel arrangement 5 can have vertically movable parts with considerable range of vertical movement without risk of collision between components.

The distance between the lowermost landing L and the hoistway pit are preferably located relative to each other so that the sill s of the lowermost landing of the elevator is more than 1 m, more preferably more than 2 m, above the upper face of the floor 9 of the hoistway 1.

Said lowermost landing is the lowermost landing to which and/or from which the passenger or the goods to be loaded can pass between the elevator car and the landing during normal use of the elevator.

The bridge structure 7 is preferably made so robust that the cross member 7*a* supports the guide rail 6*b* vertically, namely at least part of the weight thereof. In this case, the guide rail 6*b* is not only above the cross member 7*a* of the bridge structure 7 but also placed to rest on top of it, such as on an upper face thereof.

The bridge structure 7 is immovably mounted on the floor of the hoistway 1, in particular such that it rests on the floor 9 of the hoistway. Thus, it can transmit vertical loads to the floor 9. As illustrated, the bridge structure 7 preferably comprises a first elongated support leg 7*b* and a second elongated support leg 7*c* standing on the floor 9 of the hoistway 1, which first and second support leg 7*b*, 7*c* are displaced in depth direction d of the hoistway 1, which first and second support leg 7*b*, 7*c* each support in vertical direction the cross member 7*a*, the passage 8 extending below the cross member 7*a* between the first and second support leg 7*b*, 7*c* in width direction w of the hoistway 1. The cross member 7*a* is connected with the upper ends of the first and second support leg 7*b*,7*c*. Said elongated support legs 7*b*,7*c* are preferably oriented vertically as illustrated. That is, the central axes thereof are oriented to be vertical. Said cross member 7*a* is preferably oriented horizontally, as illustrated. That is, the central axis thereof is oriented to be horizontal. Preferably, each of said first support leg 7*b* and said second support leg 7*c* comprises a vertically oriented metal beam. Likewise, it is preferable that the cross member 7*a* comprises a horizontally oriented metal beam. A metal beam structure is preferable as it is simple to dimension to withstand great loads, such as loads caused by guide rail 6*b*. For instance if the elevator car brakes with its safety gear acting on the guide rail 6*b*, the bridge structure 7 can withstand loads caused in such a situation.

Each of said first support leg 7*b*, said second support leg 7*c* and said cross member 7*a* is positioned such that the central axis thereof extends along a common vertical plane 21 extending parallel with depth direction d of the hoistway 1. Thus, space consumption in width direction is minimized, and room is left for other components, such as buffers 13*a*,13*b* of the elevator car 2 and buffer 14 of the counterweight 3.

In the preferred embodiment, the one or more ropes 4 comprise plurality of ropes 4. In this context, space savings in depth direction of the hoistway are particularly preferable as in this direction the rope shape tends to require lots of space. The number of the ropes is in the presented examples three, but the solution is most preferable when the number is even greater, such as more than 8. In the preferred embodiment, the ropes 4 pass side by side in depth direction of the hoistway each along a vertical plane extending parallel with width direction of the hoistway, the planes of the ropes 4 being beside each other in depth direction of the hoistway 1. In the preferred embodiment, the number of ropes is an odd number. In this context, the solution is particularly preferable because dividing the ropes to pass on opposite depth directional sides of the car guide rails would cause asymmetry and thereby more complicated balancing of the car and positioning of the guide rail. In the preferred embodiment, the one or more ropes are belt-shaped. In this context space savings in depth direction d of the hoistway are particularly preferable because in this direction the rope shape tends to require lots of space.

As illustrated, the rope wheel arrangement 5 is preferably such that comprises a first rope wheel 5*a*, and a second rope wheel 5*b*, which have parallel rotational axes that extend in depth direction of the hoistway, and which are beside each other in width direction w of the hoistway 2, and the first rope wheel 5*a* is arranged to divert the rope(s) arriving thereto from the counterweight 3 to pass to the second rope wheel 5*b*, and the second rope wheel 5*b* is arranged to divert the rope(s) 4 arriving thereto to pass up to the elevator car 2. In the presented example, the second rope wheel 5*b* is at least partially below the cross member 7*a* of the bridge structure 7 and the vertical projection of the second rope wheel 5*b* at least partially overlaps the vertical projection of the cross member 7*a*.

Said rope wheel arrangement 5 is mounted on the floor 9 of the hoistway 1. It comprises a frame 5*c* mounted immovably on the floor of the hoistway 1 on which frame 5*c* the rope wheels 5*a*, 5*b* of the rope wheel arrangement 5 are mounted. Said frame 5*c* is separate from the bridge structure 7. The rope wheels of the rope wheel arrangement 5 are mounted vertically movably on said frame 5*c*. Thus, they can serve the functions preferable for the roping hanging between the car 2 and counterweight 3, such as maintaining adequate rope tension in changing car load situations and possibly even increasing tensioning of the ropes 4. The range of movement of the rope wheels 5*a*,5*b* is limited, preferably to be less than 1 m.

Said rope wheel arrangement 5 comprises one or more casings 5*d* inside which the rope wheels 5*a*,5*b* are mounted and which one or more casings 5*d* are mounted vertically movably on the frame 5*c*. Said frame 5*c* comprises a vertically oriented guide rail 5*f* for guiding the movement of the one or more casings 5*d*. In the presented embodiment, the rope wheels 5*a*,5*b* share a common casing.

Said rope wheel arrangement 5 is preferably separate from the bridge structure 7, as illustrated. This preferable as these elevator components often need to be positioned separately depending on the specific dimensions of the specific elevator and they need to be dimensioned differently to serve different functions. However, it is not absolutely necessary to make these separate as some of their immovable parts could be connected together.

Said rope wheel arrangement 5 is for guiding ropes without driving them. Accordingly, it comprises only non-driven rope wheels 5*a*,5*b*, said one or more ropes interconnecting the elevator car 2 and the counterweight 3 being arranged to pass around non-driving rope wheels only.

The elevator preferably further comprises other components for performing functions typically expected and/or needed. The elevator further comprises vertically oriented guide rails 12*a*,12*b* for guiding the counterweight. These guide rails 12*a*,12*b* extend vertically, preferably on opposite sides of the counterweight 3 in depth direction of the hoistway 1, as illustrated in Figures. For enabling guidance of the elevator car 2, the elevator comprises guide members 18*a*,18*b* mounted on the elevator car 2 and arranged to lean horizontally on the guide rails 6*a*,6*b* of the elevator car 2. For enabling guidance of the counterweight, the elevator comprises guide members 19*a*,19*b* mounted on the counterweight 3 and arranged to lean horizontally on the guide rails 12*a*,12*b* of the counterweight 3. Moreover, the elevator preferably comprises one or more buffers 13*a*, 13*b* for the elevator car mounted on the floor 9 of the hoistway 1 below the elevator car 2. In the preferred embodiment, there are two buffers 13*a*, 13*b* on opposite sides of the vertical guide rail plane 20 of the elevator car 2 along which the guide rails 6*a*,6*b* of the elevator car 2 extend. The buffers 13*a*, 13*b* are positioned furthermore preferably such that their vertical longitudinal axes are on a common vertical plane 22 extending parallel with depth direction d of the hoistway 1. Said plane 22 preferably extends via center of gravity of the elevator car 2. Likewise, the elevator preferably comprises one or more buffers for the counterweight 3. In the preferred embodiment, there is a buffer 14 for the counterweight 3 mounted on the floor 9 of the hoistway 1 below the counterweight 3. For the purpose of attaching the ropes at the suspension points 2*a*,3*a* the elevator comprises rope terminals 2*b*,3*b* whereto the rope ends are fixed.

In the Figures, the upper parts of an elevator have not been showed. The upper parts of an elevator can be as described hereinafter, but also other alternative kind of configurations are known in prior art. Generally, it is preferable that the elevator comprises one or more suspension ropes interconnecting the elevator car 2 and the counterweight 3, and a rope wheel arrangement of the one or more suspension ropes in or at least in proximity of the upper end of the hoistway for guiding the one or more suspension ropes, the one or more suspension ropes passing around rope wheels of the rope wheel arrangement. The elevator preferably further comprises a motor for rotating one of the rope wheels of the of the rope wheel arrangement of the suspension ropes.

The elevator preferably further comprises a control unit (not showed) for automatically controlling rotation of said motor, whereby the movement of the car 2 is also made automatically controllable In the preferred embodiment illustrated in Figures, the ropes are belt shaped. This is preferable as the space savings are most considerable with this type of elevator. However, this is not necessary as alternative shapes could be used.

In the preferred embodiment illustrated in Figures, the ropes have been connected with the car and counterweight by their ends, whereby ratio 1:1 is realized. The elevator could however alternatively be implemented with some other ratio, such as with 2:1 or 4:1 ratio. The ropes 4 would then be connected with the car and counterweight via rope wheels.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims.

The invention claimed is:

1. An elevator comprising:

a hoistway;

an elevator car vertically movable in the hoistway, the passage to and/or from the elevator car being provided in a depth direction of the hoistway;

a counterweight vertically movable in the hoistway beside the elevator car in width direction of the hoistway;

one or more ropes interconnecting the elevator car and the counterweight, and hanging from these;

a rope wheel arrangement in the bottom end of the hoistway for guiding the one or more ropes;

a vertically oriented guide rail for guiding the elevator car extending vertically between the elevator car and the counterweight; and a bridge structure mounted on the floor of the hoistway, the bridge structure comprising a cross member, wherein the guide rail for guiding the elevator car is mounted on top of the cross member, wherein the bridge structure comprises a passage for the one or more ropes below the cross member, wherein the one or more ropes pass from the counterweight downwards to the rope wheel arrangement, and wherein the rope wheel arrangement is arranged to guide the one or more ropes to pass below the cross member via said passage and up to the elevator car.

2. The elevator according to claim 1, wherein the cross member is arranged to support the guide rail vertically.

3. The elevator according to claim 2, wherein the cross member comprises an upper face on top of which the guide rail is mounted, and which upper face is more than 1 m above the upper face of the floor of the hoistway, yet below the sill of the lowermost landing of the elevator, the guide rail resting on said upper face.

4. The elevator according to claim 2, wherein the cross member comprises an upper face on top of which the guide rail is mounted, and a lower face delimiting the passage below it, which lower face is more than 0.8 m above the upper face of the floor of the hoistway, yet below the sill of the lowermost landing of the elevator.

5. The elevator according to claim 2, wherein said one or more ropes comprise one or more ropes that pass below the bridge structure such that they cross the vertical projection of the guide rail.

6. The elevator according to claim 1, wherein the cross member comprises an upper face on top of which the guide rail is mounted, and which upper face is more than 1 m above the upper face of the floor of the hoistway, yet below the sill of the lowermost landing of the elevator, the guide rail resting on said upper face.

7. The elevator according to claim 6, wherein the cross member comprises an upper face on top of which the guide rail is mounted, and a lower face delimiting the passage below it, which lower face is more than 0.8 m above the upper face of the floor of the hoistway, yet below the sill of the lowermost landing of the elevator.

8. The elevator according to claim 1, wherein the cross member comprises an upper face on top of which the guide rail is mounted, and a lower face delimiting the passage below it, which lower face is more than 0.8 m above the upper face of the floor of the hoistway, yet below the sill of the lowermost landing of the elevator.

9. The elevator according to claim 1, wherein said one or more ropes comprise one or more ropes that pass below the bridge structure such that they cross the vertical projection of the guide rail.

10. The elevator according to claim 1, wherein the elevator comprises vertically oriented guide rails for guiding the elevator car extending vertically on opposite sides of the elevator car in a width direction of the hoistway, said guide rails of the elevator car being positioned such that their vertical longitudinal axes are on a common vertical plane extending parallel with width direction of the hoistway.

11. The elevator according to claim 1, wherein said one or more ropes comprise one or more ropes that are connected with a suspension point of the counterweight and with a suspension point of the elevator car, which suspension points are on the same vertical plane as the guide rail, said vertical plane being parallel with width direction of the hoistway.

12. The elevator according to claim 1, wherein the passage extends below the cross member in width direction of the hoistway, whereby one or more ropes can pass via it in width direction of the hoistway.

13. The elevator according to claim 1, wherein the bridge structure is immovably mounted on the floor of the hoistway, such that it rests on the floor of the hoistway.

14. The elevator according to claim 1, wherein the bridge structure comprises a first support leg and a second support leg, standing on the floor of the hoistway, which first and second support leg are displaced in depth direction of the hoistway, and which first and second support leg each support vertically the cross member, the passage extending in width direction of the hoistway below the cross member between the first and second leg.

15. The elevator according to claim 14, wherein each of said first support leg, said second support leg and said cross member is elongated and positioned such that the central axis thereof extends along a common vertical plane extending parallel with depth direction of the hoistway.

16. The elevator according to claim 1, wherein the guide rail is positioned between the central third of the depth of the elevator car and the central third of the depth of the counterweight.

17. The elevator according to claim 1, wherein the suspension point of the counterweight is positioned within the central third of the depth of the counterweight and the suspension point of the elevator car is positioned within the central third of the depth of the elevator car.

18. The elevator according to claim 1, wherein said rope wheel arrangement comprises a first rope wheel, and a second rope wheel, which have parallel rotational axes, and the first rope wheel is arranged to divert each rope arriving thereto from the counterweight to pass to the second rope wheel, and the second rope wheel is arranged to divert each rope arriving thereto to pass up to the elevator car.

19. The elevator according to claim 1, wherein said rope wheel arrangement comprises a frame mounted immovably on the floor of the hoistway on which frame the rope wheels of the rope wheel arrangement are mounted vertically movably.

20. The elevator according to claim 1, wherein said rope wheel arrangement comprises only non-driven rope wheels.

* * * * *